United States Patent [19]

Kistner et al.

[11] 4,076,232

[45] Feb. 28, 1978

[54] APPARATUS FOR LIFTING AND CONVEYING A SIGNATURE FED ON A WEDGE-SHAPED SADDLE

[75] Inventors: Hermann Kistner, Tamm; Gunthart Lehmann, Heubach, Lautern, both of Germany

[73] Assignee: Maschinenbau Oppenweiler GmbH, Oppenweiler, Germany

[21] Appl. No.: 672,434

[22] Filed: Mar. 31, 1976

[30] Foreign Application Priority Data

Apr. 4, 1975 Germany ..... 2514838

[51] Int. Cl.[2] ..... B65H 39/02

[52] U.S. Cl. ..... 270/54

[58] Field of Search ..... 270/53–57, 270/60

[56] References Cited

U.S. PATENT DOCUMENTS 1,287,334 12/1918 Kast ..... 270/53

1,750,622 3/1930 Belluche ..... 270/53

*Primary Examiner*—Clifford D. Crowder
*Assistant Examiner*—A. Heinz
*Attorney, Agent, or Firm*—Wigman & Cohen

[57] ABSTRACT

An apparatus for lifting a signature fed on a wedge-shaped saddle to a conveyor by an upwardly and downwardly movable lifting comb, which conveyor comprises at least one pair of conveyor elements, one of them being wheel-shaped and the other one being an elongated flexible endless member which is mounted for revolving movement along an endless path. Said path is defined by deflecting means and runs along a segment of the peripheral surface of the wheel-shaped element so as to form a conveyor gap for conveying the signature lifted by said lifting comb. In a transfer station, a pressing means is provided for pressing the lifted signature to the wheel-shaped conveyor element for transferring the signature from the lifting comb to the mouth of the conveyor gap.

21 Claims, 11 Drawing Figures

Fig.5.
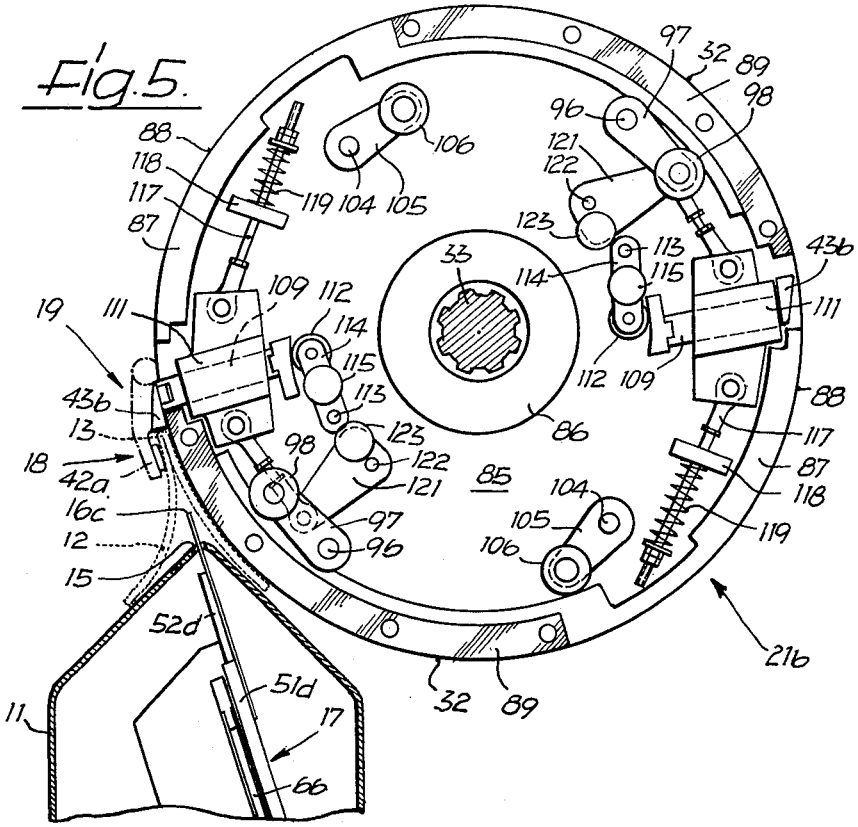
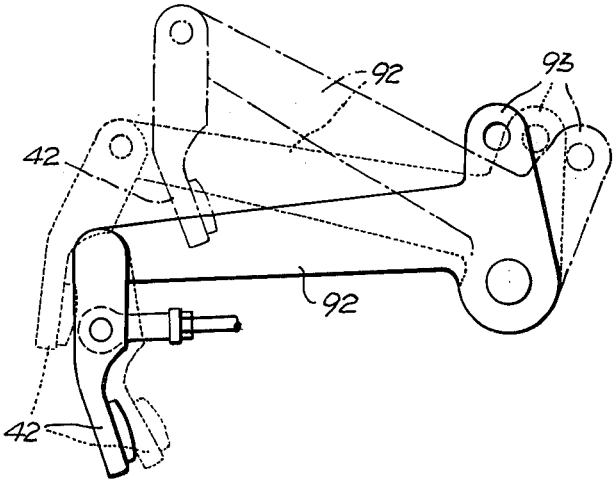
Fig.6.

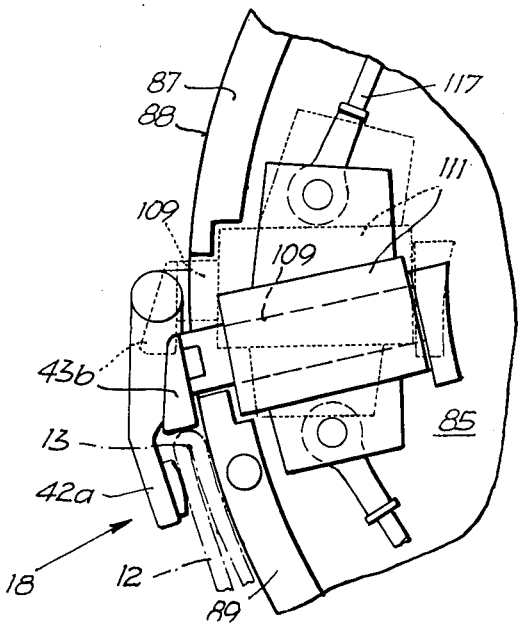
Fig. 7.
Fig. 10.
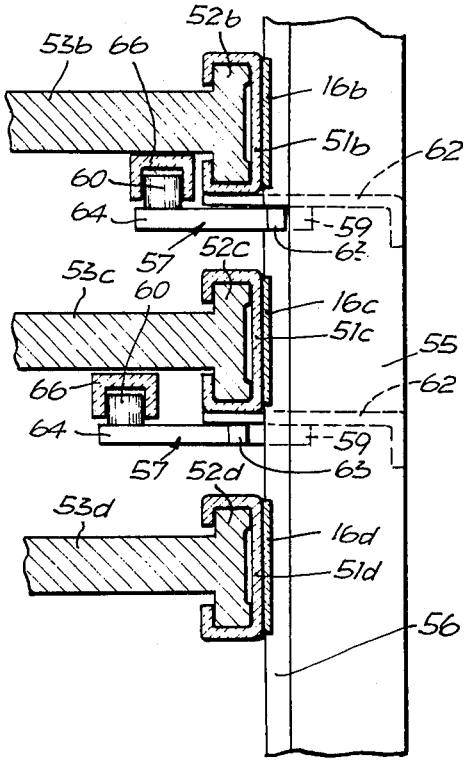
Fig. 11.
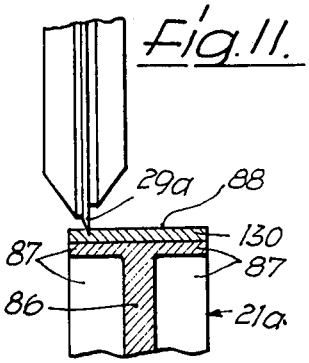

APPARATUS FOR LIFTING AND CONVEYING A SIGNATURE FED ON A WEDGE-SHAPED SADDLE

BACKGROUND OF THE INVENTION

1. Field of the Invention

The invention relates to an apparatus for lifting and conveying a signature fed on a wedge-shaped saddle or saddle conveyor, which signature lies with the inner side of its back on the vertex of the saddle. The apparatus comprises an upwardly and downwardly movable lifting comb which has comb tongues with upper edges for moving below the inner side of the signature back and which serves to lift the signature from the saddle to a transfer station, where it is transferred from the lifting comb to a conveyor which has at least two conveyor elements with endless conveyor surfaces lying side by side to form a clamping gap for the signature and being movably mounted for movement along endless paths in order to advance the signature for further processing. The apparatus further comprises drive members for driving the lifting comb and at least one of the two conveyor elements.

2. Description of the Prior Art

The term "signature" as used herein shall mean a booklet and designates superposed or nested foils or sheets, preferably paper sheets, which are folded together about a common fold line, said fold line defining a signature back or backbone. The margin of the signature adjacent to this signature back will be referred to in the following as "back margin". The foils or sheets constituting the signature can be stitched together by staples, or glued together at the signature back. However, they may also be arranged in loose contact with each other. In the known apparatus of the above-mentioned type, conveyor elements are used which consist of rollers and/or conveyor belts lying side by side so as to define a clamping gap. It is to this clamping gap that the signature lifted from the saddle is fed by the comb tongues in the known apparatus. It has however to be taken into consideration that the upwardly and downwardly moving lifting comb transfers the signature to the clamping gap in its upper dead-center position. The lifting movement of the lifting comb must therefore have been delayed to zero by the time the signature is introduced into the clamping gap. In view of the high demands on the output of apparatus of the above-mentioned type, this will result in accelerations and delays of the order of magnitude of a multiple of the acceleration by gravity. Thus it cannot be avoided with certainty in the known apparatus of the above-mentioned type that due to the considerable delay in the movement of the lifting comb, the signature will come off the upper edges of the comb tongues immediately in front of the clamping gap and reach the clamping gap prematurely and in an inaccurate position. For this reason it is known that additional aligning means have been provided for the further handling of the signatures, which exactly re-position the signature before it is further processed, for example trimmed.

It is the object of the invention to provide an apparatus for lifting and advancing a signature fed on a wedge-shaped saddle, wherein the signature is introduced into the clamping gap in an exactly defined position so that additional aligning is not necessary.

SUMMARY OF THE INVENTION

In accordance with the invention this object is attained in an apparatus according to the invention in that the transfer station is arranged at a distance from the mouth of the clamping gap in a direction opposite to the conveying direction of the conveyor, in that this conveyor comprises at least one pressing means or clamping jaw movably mounted between a release and a clamping position in which it can be moved together with the conveyor surface of one of its associated conveyor elements in order to press or clamp the back margin of a signature, lifted by the lifting comb to the transfer station, for a certain clamping period to said conveyor element, in that there is a drive means for the pressing means, which moves said pressing means from its release postion to its clamping position and back again in response to the position of the associated conveyor element and in that the drive means of lifting comb, conveyor element and pressing means are so operatively connected to each other that the upper edges of the comb tongues reach the transfer point at a speed which substantially equals the speed of revolution of the conveyor surfaces of the conveyor elements.

Due to the fact that the transfer station is arranged at a distance from the mouth of the clamping gap in a direction opposite to the direction of movement of the conveyor surface and that the back margin of the signature lifted by the lifting comb is clamped to the one conveyor surface by the pressing means at this transfer station, the drive means of the lifting comb, the conveyor element and the pressing means can be operatively connected to each other, so that the upper edges of the comb tongues reach the transfer station at substantially the same speed as the speed of the conveyor surfaces of the conveyor elements so that the signature is fed to the transfer station substantially at the speed of the conveyor surfaces and can there be pressed by the pressing means in a faultless manner. This can be achieved in the simplest way in that the revolving speed of the conveyor surfaces of the conveyor elements substantially equals the maximum lifting speed of the lifting comb. In this case it is only necessary to make provisions that the upper edges of the lifting comb reach the transfer point at the maximum lifting speed of the lifting comb. However, the possibility also exists that the lifting comb initially moves at a higher speed and that the revolving speed of the conveyor surfaces is reached during a slow delay phase in which lifting of a signature from the lifting comb is not likely.

Thus the invention makes possible a perfectly accurate transfer of the signature to a conveyor where the signature is clamped by pressing means before it is introduced into the clamping gap.

In order that the clamping of the signature in the gap should not be affected by the pressing means, it can be provided in accordance with an advantageous embodiment of the invention that the clamping gap is narrower than the signature to be advanced and that, with respect to the clamping gap, the pressing means is arranged offset from, and adjacent to the clamping gap, in a direction at right angles to the plane of revolution of a point of the conveyor surface. The plane of revolution of a point on the conveyor surface shall be understood to mean the plane which a point on an endless conveyor surface defines or lies within when such conveyor surface is revolved. For example, the plane of revolution of a point on the surface of a cylindrical conveyor rotating about its axis is defined by a plane perpendicular to the conveyor axis of rotation and passing through said point. Owing to this arrangement, the signature is pressed by the pressing means to the conveyor element adjacent to the clamping gap when its back margin passes through the clamping gap so that the clamping gap and pressing means do not influence each other. The pressing means may be movably mounted to the machine frame and may be so controlled that it is moved to its clamping position each time the back of a signature reaches the transfer station, and is moved in this position together with the conveyor surface for the clamping period.

In accordance with a further advantageous embodiment of the invention, it is provided that the engagement means for the precise positioning of the back of a signature lifted by the lifting comb to the transfer station comprises a stop means or an abutment for the signature back, which extends radially beyond the conveyor surface of a conveyor element. This results in a particularly accurate positioning of the signature at the transfer point. If the abutment is preferably arranged on the conveyor element, the conveyor surface of the conveyor element having the abutment will also have to be at least as long as the maximum width of the signatures to be advanced, as in the embodiment where the pressing means is arranged on the conveyor element, because otherwise the conveyor surface has to rotate more than once during the advance of a signature so that the abutment comes to be positioned either below the signature in the clamping gap or beside the clamping gap, while the signature is still being advanced in the clamping gap, and can no longer serve as an abutment for the following signature.

In accordance with a function advantageous embodiment of the invention it is provided that at least one conveyor surface is resilient and that the abutment is arranged at a point of the conveyor element whose path of movement runs through the clamping gap. In this manner it is possible for the clamping gap to be slightly opened during the time the abutment is in the clamping gap so that the back margin of the signature clamped by the pressing means to the conveyor surface enters the clamping gap when opened by the abutment and is only subsequently clamped by the clamping surfaces held in resilient contact with one another. Thus irregularities are avoided as may occur when a large signature back is forced into the clamping gap still closed.

The apparatus according to the invention may be designed that more than two aligned clamping gaps may be arranged at a distance from each other for one signature, and that pressing means are arranged in the spaces between these clamping gaps. However, such a complex arrangement is not necessary as a rule because the signature need only be guided by two clamping gaps at its upper and lower edges to be perfectly guided. In such a case, however, the apparatus must be adaptable to signatures of different heights. For this reason, it is provided according to a further advantageous embodiment of the invention that one pair of conveyor elements with an associated pressing means is present for the top edge and another one for the bottom edge of the signatures to be advanced and that for the purpose of adaptation to signatures of different heights, the distance between the two pairs of conveyor elements as measured perpendicularly to the surface of revolution of a point of the clamping surface is adjustable. In order to make sure in such an adjustable apparatus that the signature is accurately lifted in all positions, it may futhermore be provided that at least one comb tongue is displaceable perpendicularly to the aforementioned of revolution in order to achieve an adaptation to signatures of different heights.

With signatures of greater heights it is advisable that the inner side of the back should be supported by comb tongues not only at the edges but also between them. When the distance between the two pairs of conveyor elements is changed, then the intermediate comb tongues must also be shiftable perpendicularly to the aforementioned of revolution. It may happen as a result that a comb tongue gets below a pressing means so that it may be clamped when a signature is clamped. In order to avoid such accidents, it is provided, in accordance with a further advantageous embodiment of the invention, that a releasable coupling is present for at least one comb tongue by means of which said comb tongue can be separately connected to, or disconnected from a drive member. In this manner, comb tongues can be individually disconnected from their drive member so that clamping of the comb tongues by a clamping jaw can be avoided.

Still further embodiments and advantages of the present invention will readily occur to one skilled in the art to which the invention pertains, upon reference to the following detailed description.

BRIEF DESCRIPTION OF THE DRAWINGS

The description refers to the accompanying drawings illustrating two embodiments, in which like reference characters refer to like parts throughout the several veiws and in which

FIG. 5 shows a view along the line V — V of FIG. 3 corresponding to FIG. 4, in which the outer face of the first conveyor element located to the right of FIG. 3 is shown with its cyclindrical circumferential surface, whereby the support device with its cam plates has been left off for simplicity, which device is located in front of said first conveyor element in the direction of sight;

FIG. 6 is a view similar to that in FIG. 4 of a gripping jaw in four different positions;

FIG. 7 is an enlarged partial section of FIG. 5, showing the stop in two different positions;

FIG. 10 is an enlarged sectional view on line X — X of FIG. 9;

FIG. 11 shows a detail of a second embodiment in a partial sectional view.

DESCRIPTION OF THE PREFERRED EMBODIMENTS

Figure 1:
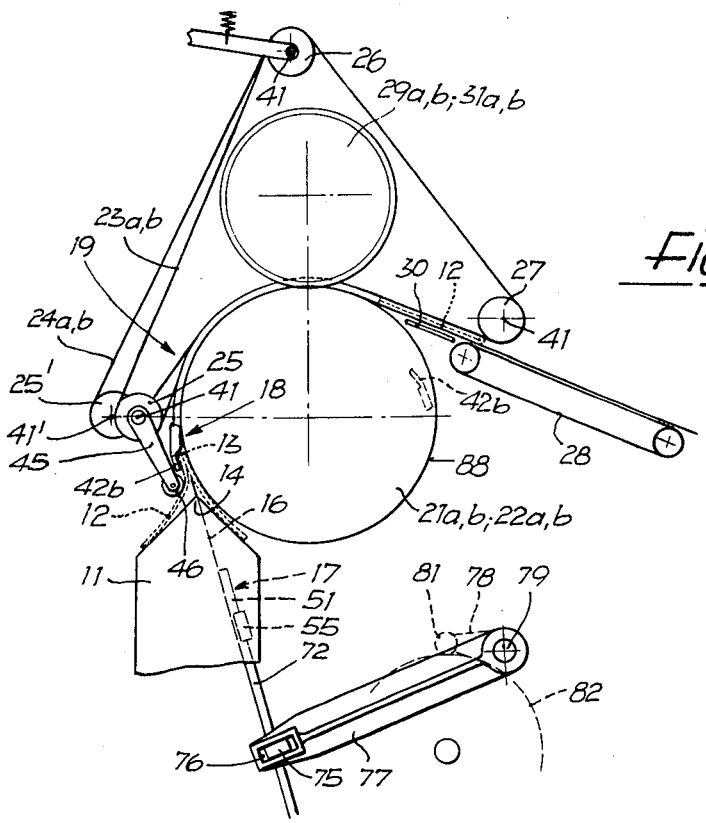
FIG. 1 is a simplified schematic side view of a first embodiment.
Figure 2:
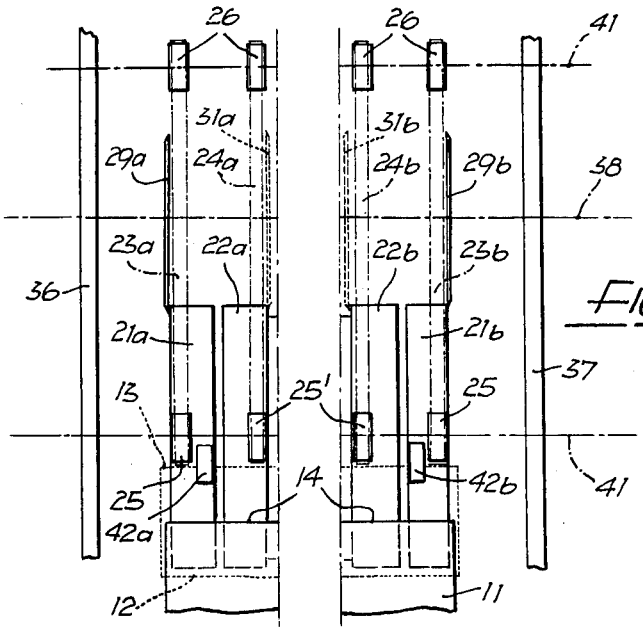
FIG. 2 is also a simplified, schematic front view as viewed from the left of FIG. 1.

Referring now to the drawings, the invention is described with reference to an apparatus for lifting and advancing a signature as illustrated in FIGS. 1–10.

General Description

As will be apparent from FIG. 1 of the drawings, the embodiment of the invention shown therein comprises a wedge-shaped saddle 11 which in the illustrated embodiment forms part of the machine housing. A stack of sheets in the form of a signature 12 which consists of superposed sheets which all together are nested so as to have a common fold line defining a signature back 13 is fed to this saddle 11. The signatures 12 are supplied to the saddle 11 in a known manner, for instance by means of the rotating collector chain described in Swiss Pat. No. 528,983 where the individual folded sheets are collected so that they form a common fold and are then supplied to the saddle 11 perpendicularly to the drawing plane of FIG. 1. The shifting means used for this purpose are also known so that they need not be described in further detail. There may be provided in a known manner stations where the signatures are during this transport checked as to their desired thickness and where they are stitched or glued together. The signature 12 is placed with the inner side of its back 13 on the saddle 11 such that the signature back 13 coincides with the vertex 14 of the saddle. This vertex 14 of the saddle 11 (FIGS. 4, 5 and 8) comprises a slot 15 for tongues 16*a, b, c* and *d* of an upwardly and downwardly movable lifting comb or jack referred to as a whole by 17 and illustrated in more detail in FIGS. 4, 8, 9 and 10. During their upward movement, the comb tongues 16 move below the inner side of the signature back 13 and thus lift the signature 12 from the saddle 11 to a transfer station or point 18 where the signature 12 is transferred by the lifting comb 17 to a conveyor designed as a clamping device referred to as a whole by 19 and having, in the illustrated embodiment, four pairs of cooperating conveyor or clamping elements 21*a*, 23*a*; 21*b*, 23*b*; 22*a*, 24*a* and 22*b*, 24*b* and two pressing means designed as two jaws 42*a* and 42*b* to be described in further detail in the following. Each of the aforementioned pairs of clamping elements consists, on the one hand, of a first conveyor element or a wheel-shaped clamping element 21*a*, 21*b*, 22*a* or 22*b* and, on the other hand, of a clamping belt 23*a*, 23*b*, 24*a* and 24*b* respectively (FIGS. 1 and 3) each of the latter constituting a flexible, endless, elongated second conveyor element, in the preferred embodiment a toothed belt (also known as a timing belt). Each of these clamping belts is so guided about three idle deflection pulleys or rollers 25 or 25', 26 and 27 that it contacts with its outer or conveyor surface a segment of about 90° of the circumference or conveyor surface of the associated clamping wheel, in order that the circumferential surface of the clamping wheel and the contacting surface of the clamping belt define a clamping gap. The uppermost deflection rollers 26 deflecting the sections of the clamping belts not in contact with the clamping wheels 21*a*, 21*b*, 22*a* and 22*b* are resiliently mounted tension rollers, so that each of the substantially non-extensible clamping belts contacts said segment of the clamping wheel in a resilient manner and the clamping gap can thus adapt itself to the thickness of each signature. The deflection rollers 25' of the central clamping belts 24*a* and 24*b* are arranged at a greater distance from the associated clamping wheels 22*a* and 22*b* than the deflection rollers 25 of the clamping belts 23*a* and 23*b* so that the clamping gaps between the clamping elements 22 and 24 grip the signature later than the clamping gaps defined between the clamping elements 21 and 23. In order to lift the signature to the transfer point in as closed a form as possible, arms 45 are secured to mounting elements (not shown) of the deflection rollers 25, said arms carrying on their free ends rollers 46 bending the outer half of the signature toward the comb tongues 16.

When the signature has been lifted from the saddle 11 by the lifting comb 17 and advanced in the clamping gap along the clamping surfaces of the clamping wheels 21*a*, 21*b*, 22*a* and 22*b*, and after it has left the clamping gap, it is fed along a table 30 to a transport device 28 consisting of conveyor belts transporting the signature to further processing means.

Whilst the signature is guided through the clamping gap of the clamping elements, its upper and lower edges are trimmed by disk-knives or revolving cutter blades 29*a* and 29*b* and a middle strip cut out by further revolving cutter blades 31*a* and 31*b*. For this purpose, the edges of the clamping wheels adjacent to the revolving cutter blades have the form of cutting edges 32. In order that the clamping belts 23*a*, 23*b*, 24*a* and 24*b* can be accurately guided in the immediate cutting range of the revolving cutter blades 29*a*, 29*b*, 31*a* and 31*b* respectively, additional lateral guide rollers are provided which for the sake of clarity have been illustrated in the drawing. These guide rollers prevent lateral deflection of the clamping belts in the cutting area.

All four clamping wheels 21*a* 21*b*, 22*a* and 22*b* are mounted on a splined or key shaft 33, the outer clamping wheels 21*a* and 21*b* being connected for rotation with the shaft, but axially displaceable, the inner clamping wheels 22*a* and 22*b* being fixedly connected with the splined shaft 33, i.e. fixed for rotation therewith and axially undisplaceable. The splined shaft itself is axially displaceable and by means of a mechanism not shown in the drawing is mounted in an exactly adjustable manner in bearing sleeves 34 so as to be axially shiftable but not rotatable relative to these bearing sleeves. The bearing sleeves 34 in turn are rotatably mounted in bearing housings 35*a* and 35*b*. The bearing housing 35*a* is mounted to a mounting wall 36 which is itself shiftable in the direction of the longitudinal axis of the splined shaft 33 and can be fixedly secured in the machine housing. The bearing housing 35*b* is mounted to a stationary wall 37 of the machine housing. The clamping wheels 21*a* and 21*b* are so connected with these bearing housings 35*a* and 35*b* that they are rotatable, but cannot be shifted in the axial direction relative to these housings 35*a* and 35*b*. The revolving cutter blades 29*a*, 29*b*, 31*a* and 31*b* are mounted in a similar manner on a splined shaft 38. This shaft is mounted in bearing sleeves 34 so as to be axially displaceable but not rotatable. The bearing sleeve 34 are mounted in bearing housings 39*a* and 39*b* so as to be rotatable but not axially displaceable. The outer revolving cutter blades 29*a* and 29*b* are so connected to these bearing housings 39*a* and 39*b* respectively that they are rotatable but cannot be axially displaced in respect to these housings 39*a* and 39*b*. The middle revolving blades 31*a* and 31*b* are fixedly arranged on the splined shaft 38. By means of an adjusting device not illustrated, either, the axial position of the splined shaft 38 and thus of the middle revolving cutter blades 31 can be adjusted. The bearing housings 39*a* and 39*b* are so mounted in the mounting wall 36 and the stationary machine wall 37 respectively that they are vertically adjustable and fixable.

Like the clamping wheels 21*a* and 21*b*, the deflection rollers 25, 26 and 27 as well as 25' are mounted on axles 41 and 41' respectively, which axles are mounted to the walls 36 and 37 so as to be shiftable in the axial direction. The deflection rollers of the inner clamping belts 24*a* and 24*b* are carried by the corresponding axles 41 and 41' so as to be axially not shiftable, but rotatable relative to the axles. The deflection rollers of the outer clamping belts 23*a* and 23*b* are again connected with the adjacent walls 36 and 37 so as to be rotatable but axially not shiftable relative to these walls and are so seated on their axles 41 that they can be rotated and axially displaced relative to these axles.

Owing to the above-described mounting of the clamping elements 21, 22, 23 and 24, the arrangement can be adjusted to signatures 12 of different heights as measured along the signature back 13, in that the mounting wall 36 is simply shifted parallel to the longitudinal axis of the splined shafts 33 and 38, in accordance with the height of the signature, and set to the desired distance. This automatically results in a corresponding ajustment of the clamping elements 21 and 23 as well as of the associated outer revolving cutter blades 29. By shifting the splined shafts 33 and 38 as well as the axles 41 and 41' accordingly, the inner clamping elements 22 and 24 can then be adjusted to a desired position.

The transfer point 18 does not coincide with the beginning of the clamping gap but is arranged in front of, and displaced in a direction opposite to the direction of movement of the clamping surfaces at a distance from the clamping gap. To constitute an inlet of the clamping device at the transfer point, the above-mentioned clamping jaws 42*a* and 42*b* are provided which serve to clamp the back edge of the signature 12, when lifted by the lifting comb, to the clamping surface of the outer clamping wheels 21*a* and 21*b*. As can be seen from FIG. 3, these clamping jaws 42*a* and 42*b* are so arranged, that their paths of movement run beside and between the paths of movement of the clamping belts 23*a* and 23*b* so that the clamping jaws 42*a* and 42*b* and the clamping belts 23*a* and 23*b* do not interfere with one another. The clamping jaws 42*a* and 42*b* are mounted to the clamping wheels 21*a* and 21*b* respectively to be movable between a release and a clamping position so that they follow the movement of the clamping surface of their clamping wheel when they are in the clamping position.

Moveover, in order to accurately position the back 13 of a signature lifted by the lifting comb 17 to the transfer point 18, stops or abutments 43*a* and 43*b* (FIGS. 3, 7) projecting radially beyond the clamping surface are mounted on the outer clamping wheels 21*a* and 21*b* for reciprocating movement between an operative position in which they project from the clamping surfaces of the clamping wheels 21*a* and 21*b* respectively and an inoperative position in which they lie below the clamping surfaces. These stops 43*a* and 43*b* are so arranged that their paths of movement coincide with the paths of movement of the clamping belts 23*a* and 23*b*. Owing to this arrangement, the stops 43*a* and 43*b* enter the clamping gaps between the outer clamping wheels 21, on the one hand, and the clamping belts 23, on the other, and momentarily open these gaps to receive the back margin of a signature 13 clamped by the clamping jaws 42 against the clamping wheels 21. As can be seen from FIG. 1, the deflection rollers 25' of the two inner clamping belts 24*a* and 24*b* adjacent to the transfer point 18 are located at a greater radial distance from the clamping wheels 22*a* and 22*b* respectively than the corresponding deflection rollers 25 of the clamping belts 23*a* and 23*b* from the clamping wheels 21*a* and 21*b* respectively. This radial distance is so chosen that the signature back can only be introduced into the clamping gap of the inner clamping elements 22 and 24 when the stops 43 have moved to their inoperative positions, and the signature has already been clamped in the clamping gaps of the clamping elements 21 and 23.

Special components of the embodiment according to the invention described generally above will be explained in more detail in the following.

The Lifting Comb

The saddle 11 defines a housing fixedly connected with the machine frame for mounting the lifting comb 17 illustrated in detail in FIGS. 4, 8, 9 and 10. Each comb tongue 16*a*, 16*b*, 16*c* and 16*d* is secured to the upper end of a comb-tongue holder 51*a*, 51*b*, 51*c* and 51*d* respectively which in section (FIG. 10) appears as a U-shaped rail and is guided for up-and-down movement on a guide edge 52*a*, 52*b*, 52*c* and 52*d* respectively of a T-shaped cross-section of a guide plate 53*a*, 53*b*, 53*c* and 53*d* respectively such that each comb tongue 16 can be moved from its lowermost position within the housing defined by the saddle 11 through the slot 15 to its uppermost position in which it has lifted the back edge of a signature 12 resting on the saddle 11 to the transfer point 18.

A hollow drive bar 55 (FIGS. 4, 9) of rectangular cross-section whose longitudinal axis runs parallel to the axis of the splined shaft 33 is provided as a drive means for all comb tongues 16*a*, 16*b*, 16*c* and 16*d*. The outer comb-tongue holders 51*a* and 51*d* are connected to this bar so as to be shiftable parallel to the longitudinal axis thereof whereas the inner comb-tongue holders 51*b* and 51*c* can be selectively coupled to the bar in such a manner that they than can also be shifted in the longitudinal direction. For this purpose, the drive bar 55 comprises a ledge 56 at its lower edge facing the comb-tongue holders 51. A U-shaped engagement member not illustrated in the drawing is secured to each of the two outer comb-tongue holders 51*a* and 51*b*, said engagement member gripping the ledge 56 from above and from below so that the comb-tongue holders 51*a* and 51*d* are so connected with the drive bar 55 that they are always shiftable in parallel with the ledge 56. In order to be able to releasably couple the two middle comb-tongue holders 51*b* and 51*c* with the drive bar 55, a latch 57 having the form of a substantially T-shaped lever is provided which comprises at the lower end of its web 58 an arm 59 which together with the web substantially defines an L, said arm being pivotable about a pivot 61 and being attached to an arm 62 provided on the associated comb-tongue holders 51*c* or 51*d* and defining an L together with the associated comb-tongue holder. The latch 57 is pivotable about this pivot 61 from the release position shown in FIG. 9 to the latching position shown in FIG. 4 and back again. In the latching position, one part 63 of the cross-piece of the T-shaped latch 57 engages the ledge 56 from above so that when the drive bar 55 is moved upwards, the coupled comb-tongue holder 51*b* or 51*c* is taken along. During its return movement, the drive bar 55 engages the arm 62 of the comb-tongue holder 51. In order that the latch 57 can be moved from the latching position to the release position and back again, the other part of its cross-piece comprises a guide pin 60 which extends into a rail 66 of U-shaped cross-section running parallel to the guide edge 52 and being guided for translatory motion by two parallel levers 70 of equal lengths which are pivotably mounted on the associated guide plates 53*b* and 53*c* respectively. Each of the two rails 66 carries on a lower extension a rotatably mounted roller 67*b* and 67*c* each of which rests on a cam 68 which extends in a plane parallel to the longitudinal axis of the drive bar 55.

The guide plates 53*a*, 53*b*, 53*c* and 53*d* are arranged parallel to each other and vertical to the axis of the drive bar 55 on two rods 69 running parallel to the longitudinal axis of the drive bar 55, with the guide plates 53*a*, *b* and *c* being shiftable vertically to their planes and the guide plate 53*d* being stationary. In order to be shiftable, each of the plates 53*a*, 53*b* and 53*c* is fixedly connected to two slider rods 71*a*, 71*b* and 71*c* respectively running parallel to the rods 69, said slider rods being connected to the mounting wall 36 to be shiftable therewith and axially adjustable relative thereto so that the distance of the guide plates 53*a*, 53*b* and 53*c* from the guide plate 53*d* and thus the distance of the comb-tongues 16*a*, 16*b* and 16*c* from the comb-tongue 16*d* can be adjusted as desired, i.e. adapted to the corresponding position of the clamping gaps of the clamping device. Since the connection of the rods 69 and 71 with the walls 36 and 37 including the intended adjustability of the slider rods 71*a*, *c* and *d* can be brought about in a known manner, these simple constructional measures need not be described here in further detail.

Figure 8:
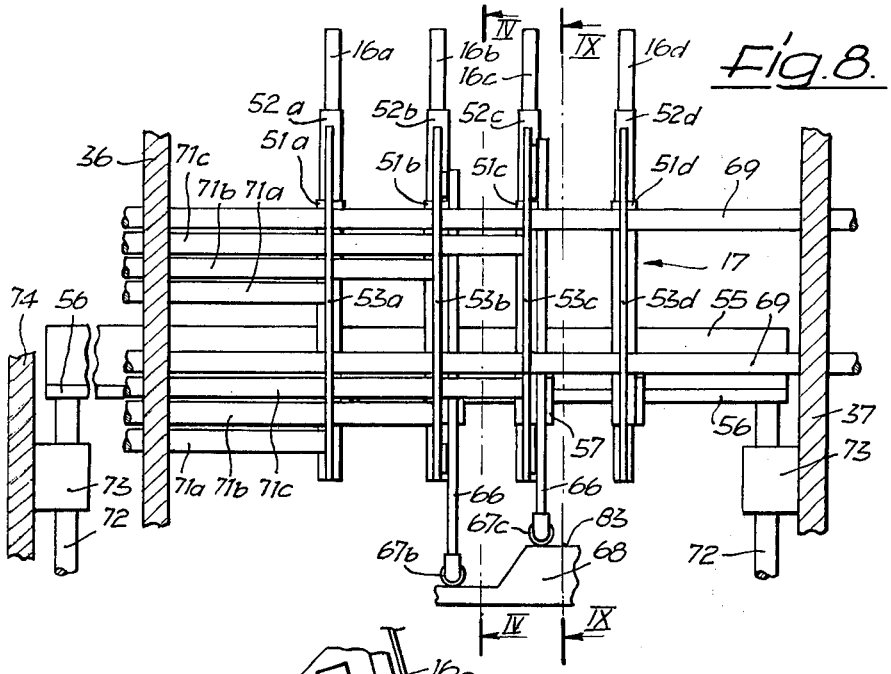
FIG. 8 is a partial sectional front view of a lifting comb.

The drive bar 55 comprises at its two ends guide rods 72 guided in guide means 73 of which the right-hand guide means 73 according to FIG. 8 is attached to the stationary wall 37 of the machine frame and the left-hand guide means according to FIG. 8 attached to a further stationary wall 74 of the machine frame. Below the guide means 73, each of the two guide rods 72 is provided with a pivotable sliding block 75 (FIGS. 1, 4) received in a recess 76 of one arm 77 of a two-armed lever 77, 78 which is pivotably mounted about a pin 79 and whose other arm 78 is urged by the pressure of a spring, not shown in the drawing, into contact with a cam disk 82, a roller 81 serving as a follower element. The drive of the cam disk 82 is derived from a central drive arrangement, not shown in the drawing, such that the device means provided in the arrangement, which will be described later, cause the precisely coordinated movements as required for the functioning of the apparatus. In this connection, the cam disk 82 itself constitutes a second drive means, in addition to the drive bar 55.

Figure 9:
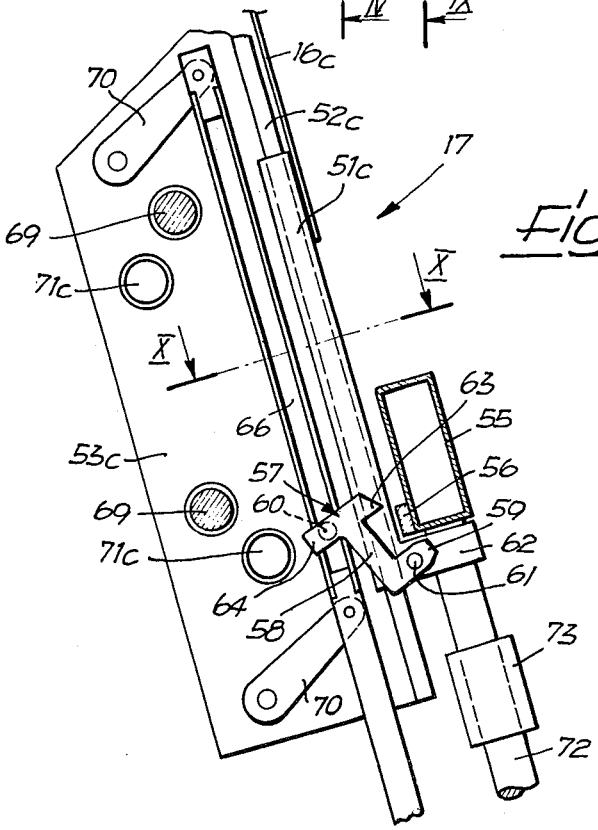
FIG. 9 is a side view on line IX — IX of FIG. 8 of a guide plate in a position in which the tongue of the comb is disgengaged from the drive member.

As a result of the rotation of the cam disk 82, the arm 77 and thus the drive bar 55 together with the comb-tongue 16 coupled to it are moved up and down. When the apparatus is adjusted to a specific signature height, the mounting wall 36 and the guide plates 53 of the comb-tongue 16 are shifted as desired perpendicularly to their planes. If, during this operation, the roller 67*c* or the two rollers 67*c* and 67*b*, provided at the lower end of the guide rails 66, run onto an elevation 83 of the cam 68, the corresponding comb-tongue holders 51*c* on the one hand or 51*c* and 51*b* on the other are disconnected from the drive bar 55 as shown in FIG. 9. The elevation 83 is for this purpose arranged at such a point that when a comb-tongue 16*b* and/or 16*c* comes within the range of the clamping jaws 42*a* and 42*b* respectively the relevant comb-tongue is disconnected from the drive bar 55. To this end, it is advantageous to have the two rollers 67*b* and 67*c* run on different cams 68 displaced at right angles with respect to the plane of movement of the comb-tongues, which for the sake of clarity, has not been illustrated in detail in the drawing.

The Wheel-Shaped Clamping Elements

Figure 3:
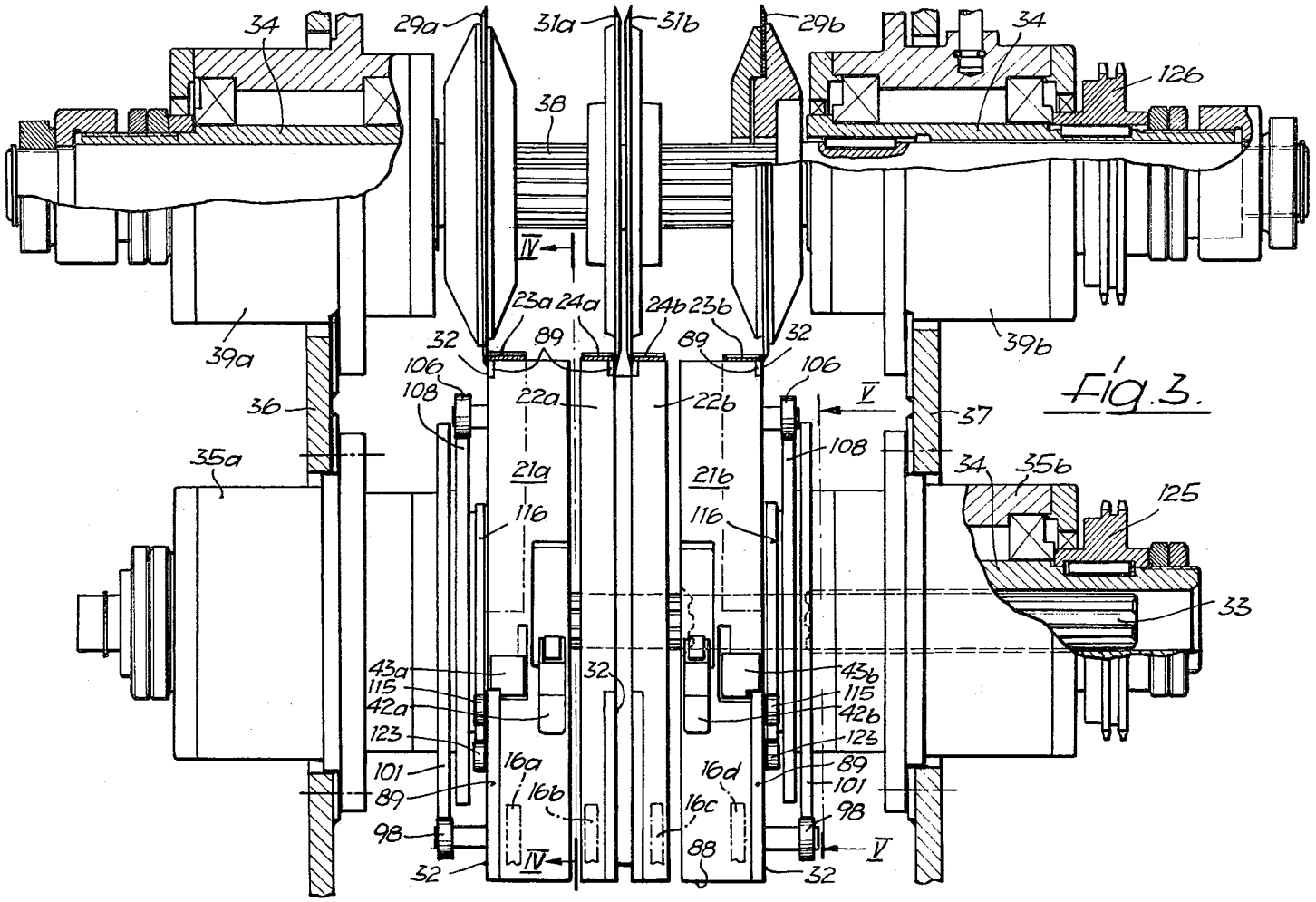
FIG. 3 is an enlarged front view of the top part of the device represented as a partial sectional view and more detailed than FIG. 2.
Figure 4:
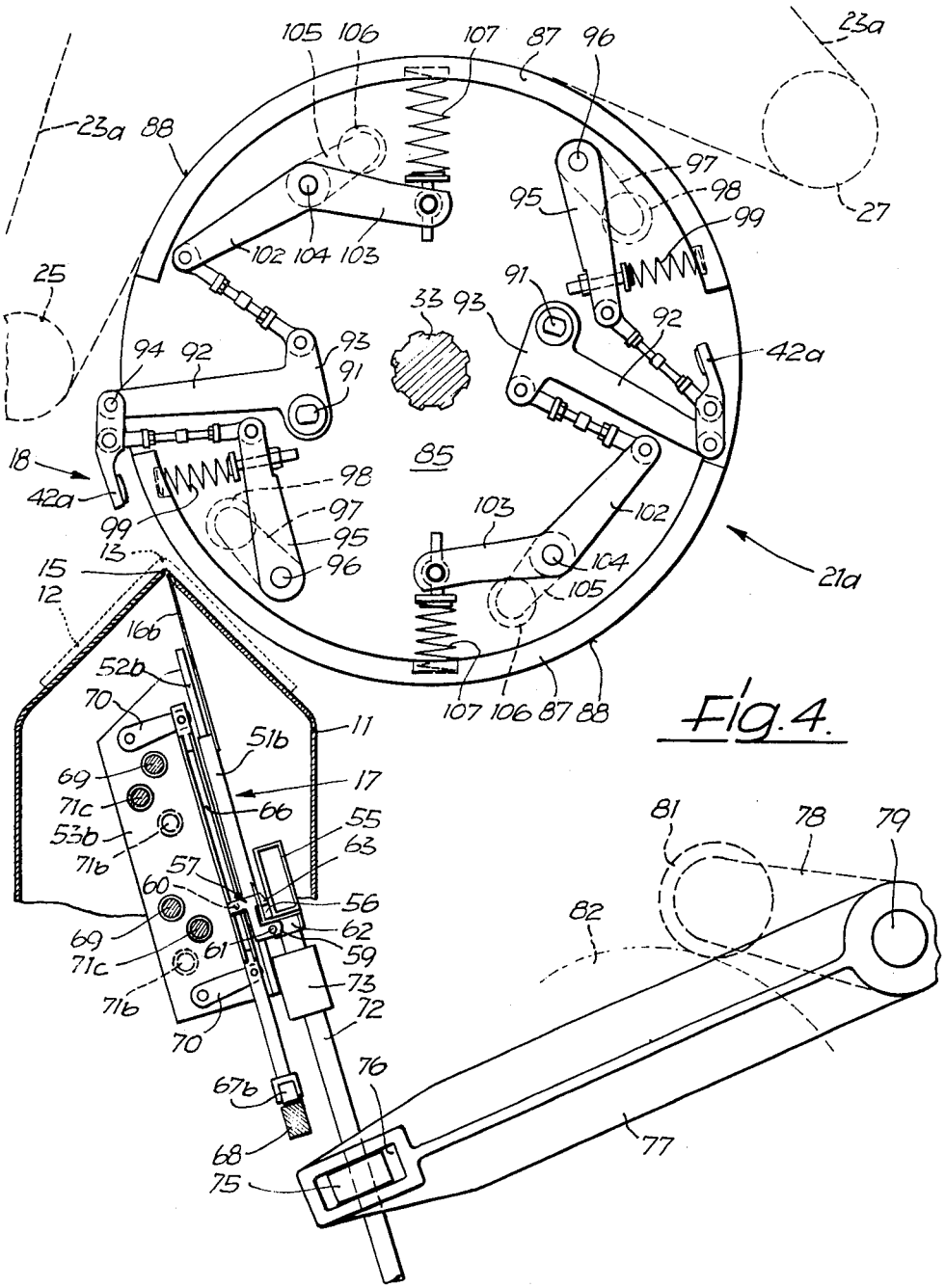
FIG. 4 is a sectional view on line IV 13 IV, the upper portion of which is taken from FIG. 3 and the lower portion of which is taken from FIG. 8, and in which the inner side of a first conveyor element with its cylindrical circumferential surface located to the left of FIG. 3, is shown in the upper portion.

The outer clamping wheels 21*a* and 21*b* are arranged and constructed in an exactly mirror-image relationship to each other. For this reason, FIGS. 4 and 5 each show the right-hand sides of the clamping wheels 21*a* and 21*b* respectively, as seen in FIG. 3 from the right, FIG. 4 showing the inner side of the clamping wheel 21*a* facing the opposite clamping wheel and FIG. 5 showing the outer side of the clamping wheel 21*b* facing away from the opposite clamping wheel 21*a*. This results in a position of the parts, arranged on different sides of each clamping wheel as if when looking at one side of the clamping wheel, one could see, through that wheel, the parts of its other side as well. For better understanding of the arrangements on the two sides of a clamping wheel, it may thus be imagined that the two FIGS. 4 and 5 are placed on top of each other.

In order to avoid repetitions, only clamping wheel 21*a* will be described in detail in the following. Its construction corresponds to the construction of the clamping wheel 21*b* in a mirror-image relationship. FIG. 5 may be understood to be an illustration of the outer side (facing away from the clamping wheel 21*b*) of the clamping wheel 21*a* as seen in FIG. 3 from the right-hand side through its disk 85. This circular disk 85 has on its outer side a central hub 86 and on its outer circumference two cylindrical clamping shells 87 each of which forms a rim axially projecting from either side of the disk 85 and an outer circular cylindrical clamping surface 88. Each of the two shells 87 has on its outer rim a cutter element 89 constituting the outer circular cutting edge 32 which co-operates with the revolving cutter blade 29*a* or, in the case of the clamping wheel 21*b*, with the revolving cutter blade 29*b*, to trim the upper and lower edges of the signature 12.

On the other, namely the inner side of the clamping wheel 21*a* (FIG. 4), two two-armed levers 92, 93 are each pivotably mounted about a pin 91. The one arm 92 of each of these levers carries at its outer free end the clamping jaw 42*a* which is pivotable about a pin 94 and is engaged by a lever 95 which is fixed to a shaft 96 rotatably mounted in the disk 85. That end of the shaft 96 which projects from the outer side (FIG. 5) of the disk 85 is fixedly connected with a second lever 97 which on its free end carries a roller 98 which serves as a follower element being urged by the force of a pressure spring 99 (FIG. 4) attached to the lever 95 to rest against a cam disk 101 (FIG. 3) secured to the bearing housing 35*a* and thus fixedly connected to the machine frame during operation. This cam serves to pivot the clamping jaw 42*a* contrary to the force of the spring 99 out of its clamping position, in which it clamps, under the force of spring 99, the back margin of a signature 12 to its release position, and then following the force of spring 99 to pivot the jaw 42*a* to its clamping position. Hence the two cam disks 101 fixed to the bearing housings 35*a* and 35*b* are present, together with the springs 99, drive means for the clamping jaws 42*a* and 42*b*.

The second arm 93 of the two-armed lever 92, 93 is hingedly connected with one arm 102 of a second two-armed lever 102, 103 fixed on a shaft 104 which is mounted for rotation in the disk 85 and whose end projecting from the other side of the disk 85 is fixedly connected with a lever 105 carrying at its free end a roller 106 which serves as a follower element and is urged by a spring 107 engaged with the second arm 103 of the two-armed lever 102, 103 to rest against a second cam disk 108 fixed to the bearing housing 35*a*. The two-armed lever 92, 93 is so arranged that the free end of its arm 92 and the clamping jaw 42*a* project from the space between the two clamping shells 87, this position being shown on the left-hand side in FIG. 4. The lever 92, 93 is held in this position by the force of the pressure spring 107. The cam disk 108 causes the two-armed lever 102, 103 to be pivoted counterclockwise opposite to the force of the spring 107 when the clamping wheel 21*a* in FIG. 4 is rotated clockwise so that the clamping jaws 42*a* are pivoted to the retracted position within the path of rotation of the clamping surfaces 88 as shown on the right-hand side in FIG. 4. Hence, the cam disks 108 and the springs 107 represent further drive means for the clamping jaws 42*a* and 42*b*.

As will be apparent from the above, during operation, the clamping wheel 21*a* rotates clockwise, in accordance with FIG. 4, so that the clamping jaw 42*a* each time cooperates with the leading end of a clamping shell 87. As a result of the pivotable mounting of the clamping jaw 42*a* on the two-armed lever 92, 93, it is possible for the clamping jaw 42*a* to be pivoted out of the space between the two clamping shells 87 as soon as the space between the two clamping shells 87 has with its leading end passed the saddle 11, and to be pivoted counterclockwise, i.e. opposite to the rotary movement of the clamping wheel 21, to the transfer position which it reaches at the same time as the leading end of the following clamping shell 87 and where it is then pivoted by the cam 101 to its clamping position to grip the back edge of the signature 12 lifted by the lifting comb to the transfer point, as is illustrated in FIG. 5.

The other, i.e. outer side of the clamping wheel 21*a* facing away from the clamping wheel 21*b* will be described in the following with reference to FIG. 5 showing the outer side of clamping wheel 21*b*. It may be imagined that all parts visible, i.e. drawn in unbroken lines in FIG. 5, are illustrated in dotted lines for the other side. This will result in exactly the arrangement of these parts on the clamping wheel 21*a* as seen in the viewing direction of FIG. 4 through the disk 85. Only the letter "*b*" of the reference numbers used in FIG. 5 must then be replaced by "*a*". In addition to the parts already described in connection with the inner side of the clamping wheel 21*a*, this outer side of the clamping wheel 21*b* shows the mounting of two stops 43*b*. Each stop 43*b* is arranged at the radially outer end of a rod-shaped slider 109 which extends more or less in the radial direction and is mounted in a guide element 11 so as to be shiftable in its longitudinal direction. This slider 109 is urged into contact with a roller 112 by the force of a spring, not shown in the drawing, which is arranged in the guide element 111 and urges the slider 109 radially inwards. The roller 112 is carried by the free end of a lever 114 pivotably mounted about a pin 113. The lever 114 is provided, between the roller 112 and the pin 113, with a roller 115 which rests in contact with a cam disk 116 (FIG. 3) fixed to the bearing housing 35*a*. The guide element 111 is at one side hinged to a pull rod 117 which is guided in an eyelet 118 and whose free end is engaged by a pressure spring 119. The other side of the guide element 111 is pivotably connected to a triangular lever 121 which is pivotably mounted about a pin 122 and carries a roller 123 which also rests in contact with the cam disk 116. Due to the action of pressure spring 119 and the spring (not illustrated) in the guide element 111, the stop 43*b* is held in its inoperative position shown on the right side in FIG. 5 at the leading end of the space between the two clamping shells 87. It is moved from this position by the co-operation of the cam disk 116 with the rollers 115 and 123 to reach the operative position shown on the left-hand side in FIG. 5 at the trailing end of the space between the clamping shells 87. Hence the cam disks 116 represent drive means for the stops 43*a* and 43*b*.

In a similar manner as described above in connection with the clamping jaws 42*a*, the stops 43*a* and 43*b* having passed the saddle 111 are first moved by the lever 114 radially outwards from the inoperative leading position in the space between the clamping shells 87, shown on the righthand side in FIG. 5, and then moved by the lever 122 to the operative position, shown on the left-hand side in FIG. 5, at the trailing end of the space between the clamping shells 87, where they arrive exactly at the moment when the lifting comb has lifted the back edge of a signature 12 to the transfer point.

Operation

Sprocket wheels 125 and 126 (FIG. 3) which serve as drive means are attached to the end of the bearing sleeves 34 which project from the bearing housings 35*b* and 39*b* respectively, which housings are secured to the stationary wall 37 of the machine housing. These sprocket wheels are driven by a common drive not shown in the drawing via chains not illustrated either. A special drive for the clamping belts 23*a*, 23*b*, 24*a* and 24*b* (FIG. 1, 2) is not necessary, because these elements are driven through the clamping wheels 21*a*, 21*b*, 22*a* and 22*b* with which they are held in contact. The cam disk 82 (FIG. 1) moving the two-armed lever 77, 78 for lifting and lowering the lifting comb 17 is also driven by this drive. The connections of these drive means, namely cam disk 82 and sprocket wheels 125 and 126 with the drive, can be adjusted to each other in their phase of motion so that the lifting comb will always lift the back edge of a signature to the transfer point 18 at a speed equal to the peripheral speed of the clamping wheels 21*a*, 21*b*, 22*a* and 22*b* when the one set of stops 43*a* and 43*b* is in its operative position shown in FIG. 7 and when the one set of clamping jaws 42*a* and 42*b* moves out of the release position shown at the left in FIG. 4 to its clamping position and thereby clamps the signature back margin to the clamping wheels 21.

After the apparatus has been adjusted to the height of the signatures fed to the saddle 11, by adjustment of the mounting wall 36, the splined shafts 33 and 38 as well as the axles 41 and 41', the drive of the apparatus is actuated. As a result, the signatures fed to the saddle 11 successively in a known manner are lifted by the lifting comb 17 with their back margin to the transfer point 18 so as to abut against the one set of stops 43*a* and 43*b* and are there clamped to the clamping wheels 21*a* and 21*b* by the one set of clamping jaws 42*a* and 42*b* in a position defined in this manner. Since the signature back margin is moved to the transfer point at a speed equal to the peripheral speed of the clamping wheels 21*a* and 21*b*, substantially no positive or negative acceleration occurs so that each signature lifted to the transfer point is clamped to the clamping wheels 21*a* and 21*b* in a position exactly defined by the one set of stops 43*a* and 43*b*, and is introduced into the clamping gap between the clamping wheels 21 and 22, on the one hand, and the clamping belts 23 and 24 on the other by the rotation of said wheels. This introduction is facilitated in that the stops 43*a* and 43*b* remain in the operative position until a back margin of the signature sufficiently broad to allow gripping of the signature has entered the clamping gap widened by the stops. As soon as this has happened, first the stops 43*a* and 43*b* and then the clamping jaws 42*a* and 42*b* are returned to their rest positions within the clamping shells 87 so that the signature is first only held by the outer clamping elements 21*a*, 23*a* and 21*b*, 23*b*. Owing to the fact that the deflection rollers 25' of the clamping belts 24 are located at a greater radial distance from the axis of the clamping wheels than the deflection rollers 25 of the clamping belts 23, the signature back only enters the inner clamping gaps not widened by stops between the clamping belts 24*a* and 24*b* and the clamping wheels 22*a* and 22*b* respectively, when the signature has already been safely gripped by the outer two clamping gaps so that in this case the accurate position of the signature clamped in the clamping gaps is not impaired either.

When the signature held in clamping gaps is further rotated, its upper and lower edges are trimmed by the revolving cutter blades 29*a* and 29*b*, the revolving cutter blades 31*a* and 31*b* cutting at the same time a middle strip from the signature so that by means of the illustrated embodiment of the apparatus, two separate signatures are produced from a double signature. Due to the fact that the signature, during the cutting operation, is held directly adjacent to the cutting knife within the entire segment extending over about 90°, in which the clamping elements on either side lie normally side by side to define the clamping gap, a perfect cut is reached. Only after the cutting area has been passed, is the trimmed signature advanced from the clamping gaps to be further transported via the table 30 and by means of the transport device 28.

The inner clamping wheels 22*a* and 22*b* and the inner revolving cutter blades 31*a* and 31*b* provided in the illustrated embodiment are only necessary if a double signature is to be divided into two individual signatures by the central double cut. If this is not required, these parts may be omitted. In the case of signatures of very great height, it may be desired to support the signature approximately in its center in the space between the clamping wheels 21*a* and 21*b* by simple supporting wheels corresponding to the clamping wheels 21*a* and 21*b*.

However, these supporting wheels may also be designed as clamping wheels as in the illustrated embodiment and co-operate with the clamping belts 24*a* and 24*b*, without the revolving cutter blades 31*a* and 31*b* being provided. In the illustrated embodiment, two clamping shells 87 are provided at one clamping wheel 21, these clamping shells being effective for successive signatures. This is advantageous in that it permits an exactly diametrically opposed arrangement of the spaces between the clamping shells and all associated components such as the clamping jaws 42, the stops 43 and the like, with the result that unbalances can be avoided and the spaces can be used as exit openings for the clamping jaws and the stops. This arrangement also results in a larger diameter of the clamping wheels than of the revolving cutter blades whereby the cutter elements 89 are easier to exchange. The length of the clamping shells as measured along the circumference is at least as great as the maximum width of the signatures to be transported by the arrangement so that it can never happen that a signature clamped to one clamping shell overlaps with its trailing edge, the clamping jaws 42 and the stops 43 of the next clamping shell.

In a modified embodiment, a single clamping shell with one clamping jaw and one stop instead of two clamping shells may be provided at each clamping wheel. In this case, the clamping surface must be longer than the maximum width of a signature to be advanced. The use of toothed belts as web-shaped clamping elements 23 and 24 has the additional advantage that the teeth of these toothed belts constitute reinforcing ribs preventing the belt from being clamped between the adjacent revolving cutter blade 29 and the cutter element 89 cooperating therewith. However, other endless elongated elements such as belts, steel bands, ropes, chains or the like can also be used as endless elongated clamping elements 23 and 24.

In the illustrated embodiment, the clamping jaws 42 and the stops 43 are movably mounted on the clamping wheel 21. However, they may also be mounted for movement in the machine frame in such a manner that they move together with the circumference of the clamping wheel 21 when in their operative positions.

In FIG. 11, a modified embodiment is illlustrated in which in contrast with the preceding embodiment, the edge of the clamping wheel 21, 22 adjacent to the revolving cutter blade 29, 31 is not constructed as a counter knife 32. For the purpose of illustration, FIG. 11 only shows the clamping wheel 21*a* in connection with the revolving cutter blade 29*a*. In this embodiment, the arrangement shown refers to all cutting devices as formed by the remaining wheel-shaped and belt-shaped clamping elements. According to this embodiment, the circumferential surface of the clamping wheel 21*a* is covered with a cuttable layer 130 made, for instance, of plastics material, and the clamping surface 88 reaches below the revolving cutter blade 29*a* so that said blade cuts into the layer 130. Thus the cuttable layer 130 constitutes a counter knife.

Although the invention has been illustrated and described with reference to the preferred embodiments thereof, it should be understood that it is in no way limited to the details of such embodiments, but is capable of numerous modifications within the scope of the appended claims.

What is claimed is:

1. In an apparatus for lifting and advancing a signature consisting of sheets which are folded together about a common fold line defining a signature back having an outer and an inner side and delimiting a back margin of the signature, the combination of:

a frame, a wedge-shaped saddle having a vertex for supporting the inner side of the signature, lifting means for lifting the signature from said saddle, said lifting means being mounted for reciprocating up-and-down movement, at least one conveyor having an inlet and an outlet for conveying the signature in a direction from said inlet along a path to said outlet, a transfer station in a fixed position relative to said frame, in which transfer station the signature lifted by said lifting means is transferred to said inlet of said conveyor, said conveyor comprising first and second conveyor elements having first and second endless conveyor surfaces respectively, and being supported on said frame for revolution of said first and second conveyor surfaces in opposite directions of revolution so that parts of said first and second conveyor surfaces move in said conveying direction and define a clamping gap between said parts of said surfaces for clamping the signature, said gap forming a mouth arranged at a distance downstream of said inlet for receiving the signature and extending along said conveyor path for conveying the signature to said outlet, said conveyor further comprising at least one pressing means for pressing the signature lifted by said lifting means to said first conveyor surface at said transfer station and for moving it thereby into said mouth of said clamping gap, said pressing means being mounted for reciprocating movement from a release position for receiving the signature from said lifting means to a clamping position for pressing the signature to said first conveyor surface for a clamping period and for moving together with said first conveyor surface at least for said clamping period, first drive means for driving at least one of said conveyor elements, second drive means for said reciprocating up-and-down movement of said lifting means, third drive means for said reciprocating movement of said pressing means from said release position to said clamping position and back, said first, second and third drive means being operatively connected to each other so that said lifting means reaches said transfer station at a moment and at a speed, when said pressing means is in said release position and starts its movement to said clamping position, and said speed of said lifting means substantially equalling the speed of said first conveyor surface.

2. Apparatus as defined in claim 1, wherein said signature has a height measured along the back margin thereof, and wherein each point of each of said conveyor surfaces defines a plane of revolution when said conveyor surfaces are revolved, said clamping gap having a width measured in a transverse direction at right angles to said plane of revolution, said width being smaller than the height of the signature to be conveyed, said pressing means being offset from said clamping gap in said transverse direction.

3. Apparatus as defined in claim 2, wherein at least one pair of pressing means is provided for each the top and the bottom margins of the signature to be advanced, and wherein for adjustment to signatures of different heights, the distance measured at right angles to said surface of revolution between said pressing means of said pair is adjustable.

4. Apparatus as defined in claim 2, wherein said first conveyor element is shaped as a wheel having, at least partially, a cylindrical circumferential surface having an axis and comprising said first conveyor surface and being mounted for rotation about said axis, and wherein said second conveyor element is a flexible endless, elongated member and including deflecting means for guiding said elongated member along a segment of said cylindrical surface of said wheel to form said clamping gap.

5. Apparatus as defined in claim 4, wherein said first conveyor means comprises at least one stop means for said back of the signature, said stop means being mounted on said first conveyor element and projecting radially from said first conveyor surface for accurate positioning of the back margin of the signature at said transfer station when the signature is lifted by said lifting means to said transfer station.

6. Apparatus as defined in claim 5, wherein said lifting means has tongues with upper edges for supporting said inner side of the signature when said lifting means lifts said signature from said saddle to said transfer station, one of said tongues being aligned with respect to said stop means.

7. Apparatus as defined in claim 6, wherein at least one of said tongues is shiftably mounted in a direction at right angles to said surface of revolution for adjustment to signatures of different heights.

8. Apparatus as defined in claim 7, wherein for each of said tongues, a guide means is provided by which said tongue is guided for its up-and-down movement parallel to said surface of revolution, at least one of said guide means being adjustable in a direction at right angles to said surface of revolution.

9. Apparatus as defined in claim 8, wherein a releasable coupling is provided for separately coupling at least one of said tongues to said second drive means.

10. Apparatus as defined in claim 9, wherein said second drive means comprises a drive bar extending at right angles to said revolving surface and an eccentric gear for up-and-down movement of said drive bar, said coupling being provided in the form of a latch means which is movable to a latching position, in which said tongue is coupled to said drive bar, and to a release position, in which said tongue is uncoupled from said drive bar, and wherein a latch controlling cam means is provided for co-operating with said latch means in response to said adjustment of said guide means.

11. Apparatus as defined in claim 10, wherein said latch means includes a pin, a guide rail provided for said pin, said guide rail extending parallel to the direction of said up-and-down movement of said tongue and being mounted on said guide means by a pair of parallel levers of equal lengths, said latch controlling cam means being arranged for co-operation with one end of said guide rail.

12. Apparatus as defined in claim 8, wherein at least one shifting means is provided for adjusting said guide means in said direction at right angles to said surface of revolution.

13. Apparatus as defined in claim 5, wherein at least one of said conveyor surfaces is resilient and said stop means is arranged at a point of said first conveyor surface the path of movement of which runs through said clamping gap.

14. Apparatus as defined in claim 13, wherein said stop means is mounted for reciprocating movement from an operative position in which it projects from said first conveyor surface, to an inoperative position, in which it lies below said first conveyor surface and back, and wherein a fourth drive means is provided for the reciprocating movement of said stop means, said fourth drive means being operatively connected to said first drive means so that said stop means is moved to its operative position before it arrives at said transfer station, and is moved back to its inoperative position when it has been moved a predetermined portion of said segment from said mouth of said clamping gap to a point within said clamping gap.

15. Apparatus as defined in claim 14, wherein said fourth drive means is operatively connected to said third drive means, so that said pressing means is moved to its release position when said stop means is already in its inoperative position.

16. Apparatus as defined in claim 14, wherein said first conveyor surface surrounds, at least partially, a space having an outlet in the form of a recess in said first conveyor surface, said pressing means being movably mounted on said first conveyor element within said space for movement from a rest position within said space through said recess to said release position in which it projects above said first conveyor surface and, during its movement through said recess, for movement substantially in a peripheral direction, opposite to said conveying direction and back to its rest position, and wherein said third drive means is operatively connected to said first drive means so that said pressing means when arriving at said transfer station is moved through its release position to its clamping position and at the end of said clamping period, to its release position, then relative to said first conveyor surface in said conveying direction, and back to its rest position.

17. Apparatus as defined in claim 16, wherein said stop means is movably mounted in said space for reciprocating movement from its inoperative position within said space through said recess to its operative position and back.

18. Apparatus as defined in claim 14, wherein at least one of said second, third and fourth drive means is provided in the form of a cam means co-operating with a follower means which is connected to said means to be moved by said drive means.

19. Apparatus as defined in claim 18, wherein said cam means of at least one of said third and fourth drive means is in the form of a cam disk fixedly mounted on said frame in a position concentrical with said cylindrical first conveyor surface and wherein said follower means is pivotably mounted on said first conveyor element.

20. Apparatus as defined in claim 1, wherein said signature has a width measured in a direction at right angles to the back of the signature, said first conveyor surface having a peripheral length at least as long as the width of the widest signature to be conveyed.

21. Apparatus as defined in claim 1, wherein said signature has a width measured in a direction at right angles to the back of the signature, said first conveyor surface having a peripheral length at least twice as long as the width of the widest signature to be conveyed.

* * * * *